US008210618B2

(12) United States Patent
Monyak et al.

(10) Patent No.: US 8,210,618 B2
(45) Date of Patent: Jul. 3, 2012

(54) REDUCED VOLUME CUTTING TIP AND CUTTER BIT ASSEMBLY INCORPORATING SAME

(75) Inventors: Kenneth Monyak, Abingdon, VA (US); Daniel Mouthaan, Williamsburg, MI (US); Joseph Fader, Abingdon, VA (US)

(73) Assignee: Sandvik Intellectual Property AB, Sandviken (SE)

( * ) Notice: Subject to any disclaimer, the term of this patent is extended or adjusted under 35 U.S.C. 154(b) by 101 days.

(21) Appl. No.: 12/192,195

(22) Filed: Aug. 15, 2008

(65) Prior Publication Data

US 2009/0051212 A1 Feb. 26, 2009

Related U.S. Application Data

(60) Provisional application No. 60/935,651, filed on Aug. 23, 2007.

(51) Int. Cl.
*E21C 35/183* (2006.01)

(52) U.S. Cl. ..... 299/111; 299/113

(58) Field of Classification Search ..... 299/113, 299/111, 100–110, 112 R, 112 T; 175/426, 175/428, 434, 435
See application file for complete search history.

(56) References Cited

U.S. PATENT DOCUMENTS 3,388,757 A 6/1968 Fittinger
3,476,438 A 11/1969 Bower, Jr. ..... 299/86
3,599,737 A 8/1971 Fischer
4,150,728 A 4/1979 Garner et al.
4,176,725 A 12/1979 Shields
4,302,055 A * 11/1981 Persson ..... 299/102
4,547,020 A * 10/1985 Ojanen ..... 299/111
4,627,665 A 12/1986 Ewing et al. ..... 299/79
4,702,525 A 10/1987 Sollami et al. ..... 299/79
4,893,875 A * 1/1990 Lonn et al. ..... 299/113
4,911,503 A 3/1990 Stiffler et al.
4,940,288 A 7/1990 Stiffler et al.
(Continued)

FOREIGN PATENT DOCUMENTS

EP 395608 A * 10/1990
(Continued)

*Primary Examiner* — Sunil Singh
(74) *Attorney, Agent, or Firm* — Morgan, Lewis & Bockius LLP

(57) ABSTRACT

A cutting bit includes a body having a head and a shank, a cutting tip attached to a front surface of the head, the cutting tip including a base portion, an upper portion and a tip portion, and a cavity extending into an interior of the cutting tip a distance from a bottom surface of the base portion. The distance the cavity extends into the interior is such that a bottom of the cavity is axially closer to the tip portion than at least a portion of a skirt separating the base portion and the upper portion. The cutting tip is attached by both a mechanical connection and a joining process. An example of a mechanical connection is a post on the front surface of the head of the body inserted into the cavity of the cutting tip. A cutting tip per se, a cutting bit on a mining machine and a method of manufacturing of a cutting bit are also disclosed.

22 Claims, 2 Drawing Sheets

U.S. PATENT DOCUMENTS

| | | | | |
|---|---|---|---|---|
| 4,941,711 | A | 7/1990 | Stiffler | |
| 4,981,328 | A | 1/1991 | Stiffler et al. | |
| 5,823,632 | A | 10/1998 | Burkett | |
| 6,270,165 | B1 * | 8/2001 | Peay | 299/111 |
| 6,428,111 | B1 * | 8/2002 | Kammerer | 299/113 |
| 6,702,393 | B2 | 3/2004 | Mercier | |
| 7,172,256 | B2 | 2/2007 | Sleep et al. | |
| 7,204,560 | B2 | 4/2007 | Mercier et al. | |
| 2009/0051212 | A1 | 2/2009 | Monyak et al. | 299/111 |

FOREIGN PATENT DOCUMENTS

| | | | |
|---|---|---|---|
| EP | 0 425 552 | | 1/1995 |
| EP | 651133 | A2 * | 5/1995 |
| GB | 1089611 | | 11/1965 |
| SU | 402655 | | 10/1973 |
| SU | 781341 | | 11/1980 |
| SU | 899916 | | 1/1982 |
| WO | WO 9613968 | A2 * | 5/1996 |

* cited by examiner

REDUCED VOLUME CUTTING TIP AND CUTTER BIT ASSEMBLY INCORPORATING SAME

RELATED APPLICATION DATA

This application claims priority under 35 U.S.C. §119(e) to U.S. Provisional Application No. 60/935,651, filed Aug. 23, 2007, entitled "Reduced Volume Cutting Tip and Cutter Bit Assembly Incorporating Same", the entire contents of which are incorporated herein by reference

FIELD

The present disclosure relates to a cutting tip for a cutter bit, for example a cutter bit used in mining and construction operations. More particularly, the disclosure relates to a cutting tip formed from a hard material, such as cemented carbide, which includes a cavity in a base portion accessible from a bottom surface. A post of a cutter bit body inserts into and is bonded to the cavity.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Cemented carbide tips for soft cutting conditions generally have a flat bonding surface for joining to the body of the cutting bit. In tougher conditions, tips that utilize a "valve seat" bonding surface are preferred. Whether of the flat bottom design or the valve seat design, conventional tips for cutting bits suffer from using an excess of cemented carbide material and from difficulties during assembly.

The valve seat is formed by a solid projection of the material of the tip that is countersunk into the body of the cutting bit. While the valve seat design increases the bonding strength of the tip, it dramatically increases the volume of hard material required. Also, generally, the carbide in the valve seat does not contribute to the cutting performance of the cutting bit 2 because the valve seat is used for bonding and the cutting bit loses effectiveness well before the valve seat is exposed by wear processes.

Alignment during assembly and the bonding process can be an issue with conventional tip designs. Flat bottom tips are difficult to keep centered and valve seat tips tend to skew to one side. Because tips are often "misaligned", operators are required to correct their orientation. This can be hazardous with hot braze coils in close proximity.

SUMMARY

The disclosed cutting tip not only reduces the volume of hard material used but also increases the bonding strength and surface area. The disclosed cutting tip shortens the base portion and presses a cavity into the cutting tip from a bottom surface. The mating surface for the cutting tip on the cutting bit features a post that mates with the cavity, thus increasing the bonding area.

An exemplary cutting bit comprises a body including a head and a shank, a cutting tip attached to a front surface of the head, the cutting tip including a base portion, an upper portion and a tip portion, and a cavity extending into an interior of the cutting tip a distance from a bottom surface of the base portion. The base portion and upper portion are separated by a skirt. The distance the cavity extends into the interior is such that a bottom of the cavity is axially closer to the tip portion than at least a portion of the skirt. The cutting tip is attached to the front surface by both a mechanical connection and a joining process.

An exemplary cutting tip for a cutting bit comprises a tip portion at a first end, an upper portion, a base portion at a second end, the base portion having a bottom surface, and a cavity extending into an interior of the cutting tip from the bottom surface of the base portion. The upper portion and the tip portion meet at a break point. The base portion and upper portion are separated by a skirt. A bottom of the cavity is axially closer to the tip portion than at least a portion of the skirt.

An exemplary mining machine comprises a rotatable drum and one or more cutting bits mounted on the rotatable member. The cutting bit includes a body including a head and a shank, a cutting tip attached to a front surface of the head, the cutting tip including a base portion, an upper portion and a tip portion, and a cavity extending into an interior of the cutting tip a distance from a bottom surface of the base portion, wherein the base portion and upper portion are separated by a skirt. The distance the cavity extends into the interior is such that a bottom of the cavity is axially closer to the tip portion than at least a portion of the skirt. The cutting tip is attached to the front surface by both a mechanical connection and a joining process.

An exemplary method of manufacturing of a cutting bit comprises forming a cutting tip from a hard material, forming a post on a front surface of a head of the cutting bit, and attaching the cutting tip to the front surface by both a mechanical connection and a joining process. The cutting tip includes a tip portion at a first end, an upper portion, a base portion at a second end, the base portion having a bottom surface, and a cavity extending into an interior of the cutting tip from the bottom surface of the base portion, wherein the upper portion and the tip portion meet at a break point, wherein the base portion and upper portion are separated by a skirt, and wherein a bottom of the cavity is axially closer to the tip portion than at least a portion of the skirt. In the exemplary method, attaching the cutting tip to the front surface by the mechanical connection includes inserting the post into the cavity and attaching the cutting tip to the front surface by the joining process includes one of welding, brazing, soldering and adhesive bonding.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 1:
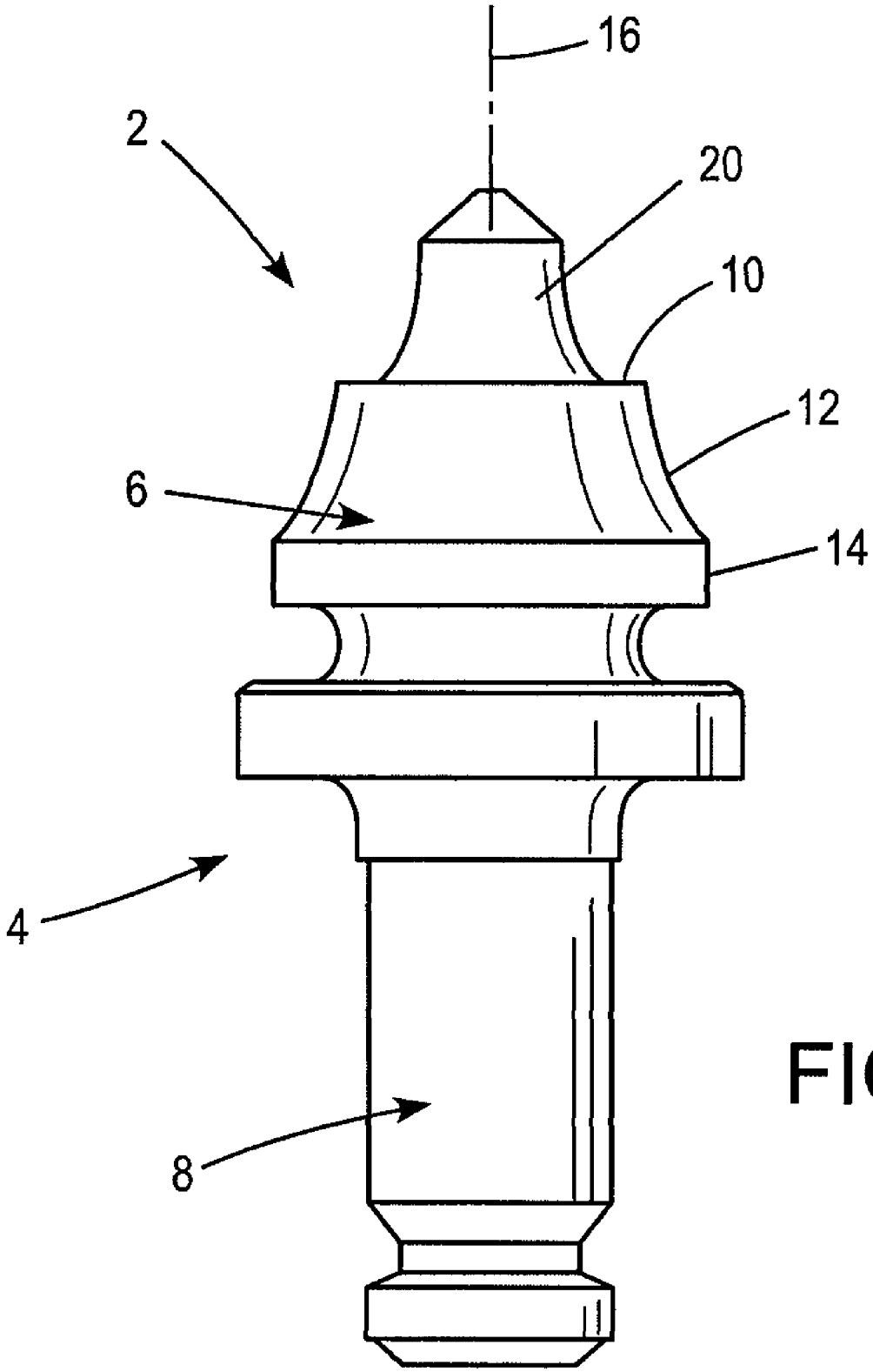
FIG. 1 schematically illustrates an exemplary embodiment of a cutting bit.

An exemplary embodiment of a cutting bit is schematically illustrated in FIG. 1. The cutting bit 2 includes a body 4 having a head 6 and a shank 8. The head 6 includes a front surface 10 and a side surface 12. The side surface 12 extends axially rearwardly from the front surface 10 toward a shoulder 14. The side surface 12 can be of various forms from being oriented substantially perpendicular to a central axis 16 of the body 4 to being oriented at an angle α to the central axis 16 (the angle α opening rearward), and combinations thereof and the form of the side surface 12 can be planar, concave, convex or combinations thereof. The side surface shown in FIG. 1 is an example of a concave form.

A cutting tip 20 is attached to the front surface 10 of the head 6. The cutting tip 20 is made from a hard material. A suitable hard material for the cutting tip 20 is cemented carbide. An exemplary composition of the cemented carbide includes 6-12wt. % Co with balance WC.

Figure 2:
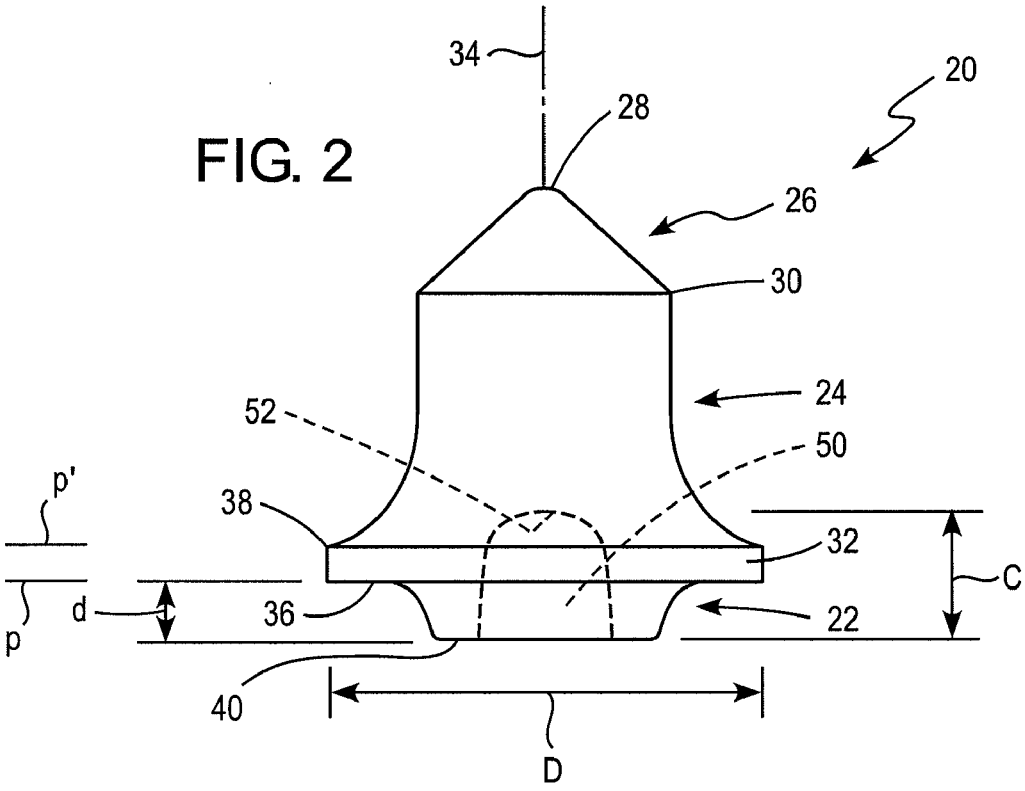
FIG. 2 schematically illustrates an exemplary embodiment of a cutting tip.

An exemplary embodiment of a cutting tip is schematically illustrated in FIG. 2. The cutting tip 20 has a base portion 22, an upper portion 24 and a tip portion 26. The upper potion 24 has a concave surface over at least a portion thereof. The tip portion 26 has a surface that extends outwardly and rearwardly from a distal end 28. The surfaces of the upper portion 24 and the tip portion 26 meet at a break point 30. The base portion 22 and the upper portion 24 are separated by a skirt 32, which is generally cylindrical and coaxial with an axis 34 running forwardly to rearwardly. The skirt 32 is generally the point of greatest diameter (D) of the cutting tip 20. The base portion 22 meets the skirt 32 at a first meeting point 36 and the upper portion 24 meets the skirt 32 at a second meeting point 38.

The base portion 22 has a bottom surface 40 that is provided axially rearward of the skirt 32 a distance (d) from the first meeting point 36. The distance (d) is reduced from conventional designs to reduce the amount of hard material used in forming the cutting tip 20. An example of a distance (d) is d=0.125×(skirt diameter (D)) or less, compared to distances in conventional designs of 0.24×(skirt diameter (D)). The arrangements disclosed herein allow the smaller ratio (d/D) of 0.125 or less.

The cutting tip 20 has a cavity 50 extending into an interior of the cutting tip 20 a distance (C) from the bottom surface 40. The cavity is radially inward from the circumference of the bottom surface. Inclusion of the cavity 50 reduces the amount of hard material used in forming the cutting tip 20, as compared to conventional designs, particularly compared to solid cutting tips without a cavity.

Although the cavity 50 can be of any shape, the distance (C) the cavity 50 extends into the interior is such that a bottom 52 of the cavity 50 is axially closer to the tip portion 26 than at least a portion of the skirt 32. In other words, the distance from the bottom 52 of the cavity 50 to the tip portion 26 is less than the distance from a portion of the skirt 32 to the tip portion 26. In an exemplary embodiment, the distance (C) the cavity 50 extends into the interior is such that a bottom 52 of the cavity 50 is axially closer to the tip portion 26 than a first plane (P) containing the first meeting point 36. Alternatively, the distance (C) the cavity 50 extends into the interior is such that the bottom 52 of the cavity 50 is axially closer to the tip portion 26 than a second plane (P') containing the second meeting point 38. In another alternative embodiment, the distance from the bottom 52 of the cavity 50 to the tip portion 26 (distance X1) and the distance from the bottom 52 of the cavity 50 to the closest portion of the skirt 32 (distance X1) is such that the relationship of X1 to X2 is X1 greater than X2.

Further, exemplary embodiments of the cavity have a largest diameter that is less than about ½ the greatest diameter (D) of the cutting tip 20. In alternative embodiments, the cavity has a diameter that is between 0.15 and 0.40 of the greatest diameter (D).

Figure 3:
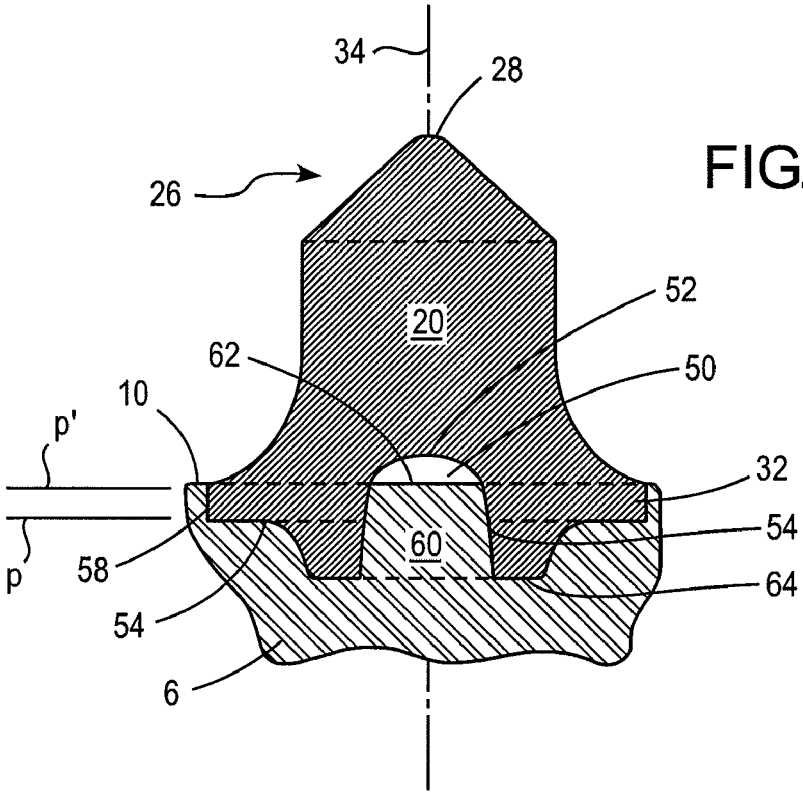
FIG. 3 shows a cross-sectional, expanded view of an exemplary embodiment of a cutting tip attached to an exemplary embodiment of a cutting bit.

FIG. 3 shows a cross-sectional, expanded view of an exemplary embodiment of a cutting tip 20 attached to an exemplary embodiment of a cutting bit 2. The cutting tip 20 is attached to the front surface 10 of the cutting bit 2 by both a mechanical connection and a joining process selected from the group consisting of welding, brazing, soldering and adhesive bonding.

An example of a joining process is welding, brazing, soldering or adhesive bonding the cutting tip 20 to the head 6 of the cutting bit 2. In this example, welding, brazing, soldering or adhesive bonding occurs at least along a portion of the mating interface 54 to fix the cutting tip to the head 6. Also for example, the front surface 10 of the cutting bit 2 is optionally recessed to define a dam wall 58 in which the cutting tip 20 is attached by a joining process, for example, brazing. Purposes of the dam wall 58 in this instance includes preventing brazing liquid or other joining process medium from flowing out from between the cutting tip 20 and the front surface 10 and acting as a stress reliever when the body 4 cools off. In exemplary embodiments, at least a portion of the skirt 32 is recessed into the dam wall 58, alternatively completely recessed into the dam wall 58.

An example of a mechanical connection is a post inserted into the cavity 50. In this example, the front surface 10 on the head 6 of the cutting bit 2 includes a post 60 that inserts into the cavity 50 of the cutting tip 20. As depicted in FIG. 3, the post 60 has a distal end 62 that is even to or below the plane of the front surface 10. However, the post 60 may or may not extend beyond the plane of the front surface 10 of the head 6 of the cutting bit 2.

In exemplary embodiments, the post 60 is inserted into the cavity 50 such that a portion of the post 60 axially extends past at least a portion of the skirt 32. In an exemplary embodiment, the portion of the post 60 is axially closer to the tip portion 26 than the first plane (P) containing the first meeting point 36. Alternatively, the portion of the post 60 is axially closer to the tip portion 26 than a second plane (P') containing the second meeting point 38. However, the post 60 may or may not contact the bottom 52 of the cavity 50.

In addition to the post 60 inserted into the cavity 50, the mechanical connection can optionally include a portion of the cutting tip 20 inserted in a recess 64 in the front surface 10 of the cutting bit 2. The recess 64 extends into the interior of the head 6 of the cutting bit 2 further than the dam wall 58, if present, is recessed. The recess is radially inward from the circumference of the front surface. At least a portion of the base portion 22 of the cutting tip 20 is inserted into the recess 64.

Together, the post 60 inserted in the cavity 50 and the (optional) portion of the base portion 22 inserted into the recess 64 form the mechanical connection attaching the cutting tip 20 to the front surface 10 of the cutting bit 2. Also, the combination of the post 60 inserted into the cavity 50 and at least a portion of the base portion 22 of the cutting tip 20 inserted into the recess 64 increases the effective surface area over which the joining process occurs. Therefore, a stronger bond results from the joining process than that for a conventional surface without posts/cavities and/or inserts/recesses.

Further, the arrangement of posts/cavities and inserts/recesses increases wear life of the cutting tip 20. First, the base portion 22 is extended for insertion into the recess 64, thereby providing more mass inserted into the volume of the head 6 of the cutting bit 2. Second, by the post 60 axially extending past at least a portion of the skirt 32, the post 60 extends past the point of maximum diameter of the cutting tip 20. Both of these arrangements tend to counteract forces generated during operation of the cutting bit 2, particularly lateral forces acting on the cutting tip 20.

In addition, the post 60 and the cavity 50 provide a self-centering feature. The portion of the base portion 22 inserted into the recess 64 also provides a self-centering feature. A slight taper on the walls of the cavity 50 and a corresponding taper on the walls of the post 60 can facilitate the mechanical insertion of the post 60 into the cavity 50. A similar concept can be utilized on the portion of the base portion 22 inserted into the recess 64. The self centering feature facilitates the bonding process by holding the cutting tip 20 and the cutting bit 2 in the desired relative positions.

An advantage of the disclosed cutting tip 20 is a reduction in machining during construction. The shorter distance (d) of the base portion 22 reduces the amount of machining on the mating front surface 10 of the head 6. This is particularly so if the mating front surface 10 includes a recess 64.

The cutting bit with the reduced volume cutting tip can be incorporated into a mining machine, construction machine, tunneling machining or trenching machine, such as Sandvik model MT720 tunneling machine or Voest-Alpine's Alpine Bolter Miner ABM 25. An exemplary mining machine, comprises a rotatable drum, and one or more cutting bits mounted on the rotatable drum. A similar construction on a rotatable member occurs in applications for road construction, tunneling and trenching. The cutting bit includes a body including a head and a shank, a cutting tip attached to a front surface of the head, the cutting tip including a base portion, an upper portion and a tip portion, and a cavity extending into an interior of the cutting tip a distance from a bottom surface of the base portion. The base portion and upper portion are separated by a skirt. The distance the cavity extends into the interior is such that a bottom of the cavity is axially closer to the tip portion than at least a portion of the skirt. The cutting tip is attached to the front surface by both a mechanical connection and a joining process.

In one example, the mechanical connection includes a post on the front surface of the head of the body inserted into the cavity of the cutting tip. Optionally, the mechanical connection includes a recess in the front surface of the cutting bit and at least a portion of the base portion of the cutting tip is inserted into the recess.

Cutting bits have the disclosed features can be manufactured by any suitable means. In one exemplary method, the cutting bit is manufactured by forming a cutting tip from a hard material, forming a post on a front surface of a head of the cutting bit, and attaching the cutting tip to the front surface by both a mechanical connection and a joining process. The cutting bit can be formed by, for example, compacting and sintering hard materials, such as cemented carbide. The post can be formed by, for example, machining or other material removal method.

The mechanical connection can include inserting the post into the cavity. The mating of the post and the cavity self-centers the cutting tip on the cutting bit. Additionally, inserting the post into the cavity positions a portion of the post axially past at least a portion of the skirt. The joining process includes one of welding, brazing, soldering and adhesive bonding.

The exemplary method can optionally include forming a recess in the front surface of the head of the cutting bit. If this optional feature is included, then attaching the cutting tip to the front surface by the mechanical connection includes inserting a portion of the base portion of the cutting tip into the recess.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A cutting bit, comprising:

a body including a head and a shank;

a post integrally formed from a same material as the head to extend from a front surface of the head;

a cutting tip attached to a front surface of the head, the cutting tip including a base portion, an upper portion and a tip portion; and a cavity extending into an interior of the cutting tip a distance from a bottom surface of the base portion, wherein the base portion and upper portion are separated by a skirt, and wherein the distance the cavity extends into the interior is such that a bottom of the cavity is axially closer to the tip portion than at least a portion of the skirt, and wherein the cutting tip is attached to the front surface by both a mechanical connection and a joining process, the mechanical connection including the post of the head being inserted into the cavity of the cutting tip.

2. The cutting bit of claim 1, wherein a portion of the post axially extends past at least a portion of the skirt.

3. The cutting bit of claim 2, wherein the base portion meets the skirt at a first meeting point and the upper portion meets the skirt at a second meeting point, and wherein the portion of the post is axially closer to the tip portion than the first plane containing the first meeting point.

4. The cutting bit of claim 2, wherein the base portion meets the skirt at a first meeting point and the upper portion meets the skirt at a second meeting point, and wherein the portion of the post is axially closer to the tip portion than a second plane containing the second meeting point.

5. The cutting bit of claim 2, wherein the post contacts the bottom of the cavity.

6. The cutting bit of claim 1, wherein the mechanical connection includes a recess in the front surface of the cutting bit, wherein at least a portion of the base portion of the cutting tip is inserted into the recess.

7. The cutting bit of claim 6, wherein the front surface of the cutting bit includes a dam wall in which the cutting tip is attached and wherein the recess extends into an interior of the head of the cutting bit further than the dam wall is recessed.

8. The cutting bit of claim 7, wherein at least a portion of the skirt is recessed into the dam wall.

9. The cutting bit of claim 7, wherein the skirt is completely recessed into the dam wall.

10. The cutting bit of claim 1, wherein the joining process is selected from the group consisting of welding, brazing, soldering and adhesive bonding.

11. The cutting bit of claim 10, wherein the cutting bit is attached by brazing.

12. The cutting bit of claim 1, wherein the skirt is the point of greatest diameter of the cutting tip and at least a portion of an outer surface of the base is radially inward of an outermost surface of the skirt.

13. The cutting tip of claim 1, wherein the cutting tip has a composition including a cemented carbide.

14. A mining machine, comprising:

a rotatable member; and one or more cutting bits mounted on the rotatable member, wherein the cutting bit includes:

a body including a head and a shank, a post integrally formed from a same material as the head to extend from a front surface of the head, a cutting tip attached to the front surface of the head, the cutting tip including a base portion, an upper portion and a tip portion, and a cavity extending into an interior of the cutting tip a distance from a bottom surface of the base portion, wherein the base portion and upper portion are separated by a skirt, wherein the distance the cavity extends into the interior is such that a bottom of the cavity is axially closer to the tip portion than at least a portion of the skirt, and wherein the cutting tip is attached to the front surface by both a mechanical connection and a joining process, the mechanical connection including the post of the head being inserted into the cavity of the cutting tip.

15. The mining machine of claim 14, wherein the mechanical connection includes a recess in the front surface of the cutting bit, wherein at least a portion of the base portion of the cutting tip is inserted into the recess.

16. The mining machine of claim 14, wherein the mechanical connection includes a recess in the front surface of the cutting bit, wherein at least a portion of the base portion of the cutting tip is inserted into the recess.

17. The mining machine of claim 14, wherein the skirt is the point of greatest diameter of the cutting tip and at least a portion of an outer surface of the base is radially inward of an outermost surface of the skirt.

18. A method of manufacturing of a cutting bit, the method comprising:

forming a cutting tip from a hard material, the cutting tip including a tip portion at a first end, an upper portion, a base portion at a second end, the base portion having a bottom surface, and a cavity extending into an interior of the cutting tip from the bottom surface of the base portion, wherein the upper portion and the tip portion meet at a break point, wherein the base portion and upper portion are separated by a skirt, and wherein a bottom of the cavity is axially closer to the tip portion than at least a portion of the skirt;

forming an integral post to extend from a front surface of a head of the cutting bit, the post formed from a same material as the head; and attaching the cutting tip to the front surface by both a mechanical connection and a joining process, wherein attaching the cutting tip to the front surface by the mechanical connection includes inserting the post into the cavity, and wherein attaching the cutting tip to the front surface by the joining process includes one of welding, brazing, soldering and adhesive bonding.

19. The method of claim 18, comprising forming a recess in the front surface of the head of the cutting bit, and wherein attaching the cutting tip to the front surface by the mechanical connection includes inserting a portion of the base portion of the cutting tip into the recess.

20. The method of claim 18, wherein the post and the cavity self-centers the cutting tip on the cutting bit.

21. The method of claim 18, wherein inserting the post into the cavity positions a portion of the post axially past at least a portion of the skirt.

22. The method of claim 18, wherein the skirt is the point of greatest diameter of the cutting tip and at least a portion of an outer surface of the base is radially inward of an outermost surface of the skirt.

* * * * *